United States Patent [19]

Robertson et al.

[11] Patent Number: 4,592,100

[45] Date of Patent: Jun. 3, 1986

[54] AIR CONTROL VALVE

[75] Inventors: Joeab A. Robertson, Benton; Virgil J. Waldorf, Little Rock; Robert D. Wilkes, Little Rock; Joe D. Pucket, Little Rock, all of Ark.

[73] Assignee: Jacuzzi Inc., Little Rock, Ark.

[21] Appl. No.: 646,538

[22] Filed: Sep. 4, 1984

[51] Int. Cl.[4] ..... E04H 3/18

[52] U.S. Cl. ..... 4/492; 4/541; 4/542; 4/488; 128/66; 137/614.2; 251/310; 251/351; 251/352

[58] Field of Search ..... 4/492, 541, 542, 426, 4/488; 251/349, 351, 352, 310, 312; 137/614.2; 128/66

[56] References Cited

U.S. PATENT DOCUMENTS

| | | | |
|---|---|---|---|
| 2,167,321 | 7/1939 | Abercrombie | 251/351 X |
| 3,067,435 | 12/1962 | Nash | 4/492 |
| 3,297,025 | 1/1967 | Jacuzzi | 128/66 |
| 3,540,438 | 11/1970 | Jacuzzi | 128/66 |
| 3,705,685 | 12/1972 | Brewer et al. | 137/614.2 X |
| 3,736,922 | 6/1973 | Schneider | 128/66 |
| 3,818,937 | 6/1974 | LaGanke | 251/310 X |
| 3,874,374 | 4/1975 | Jacuzzi | 128/66 |
| 4,034,428 | 7/1977 | Jacuzzi | 251/352 |
| 4,168,705 | 9/1979 | Raab | 128/66 |
| 4,416,030 | 11/1983 | Reynoso | 4/541 |

*Primary Examiner*—Henry K. Artis

*Attorney, Agent, or Firm*—Hill, Van Santen, Steadman & Simpson

[57] ABSTRACT

An air control valve is provided for use in a spa to regulate the flow of air to a hydrotherapy jet in which a recessed control knob is accessible at a rim of the spa to actuate a movable valve member to selectively constrict or dilate an air flow passage through the valve body which has an air intake opening underneath the spa rim to isolate the noise associated with the intake opening from the user.

11 Claims, 6 Drawing Figures

FIG. 1
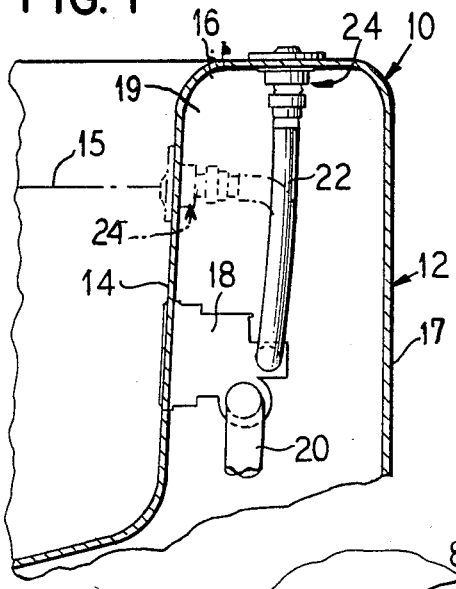
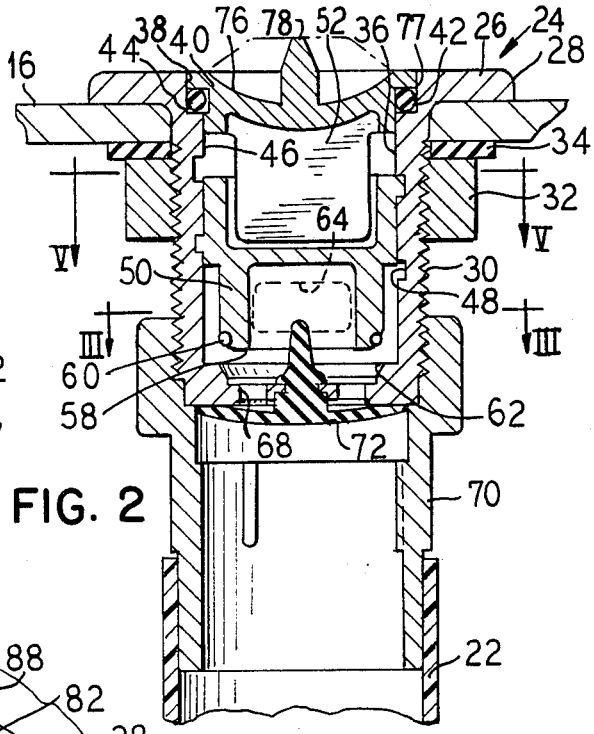
FIG. 2
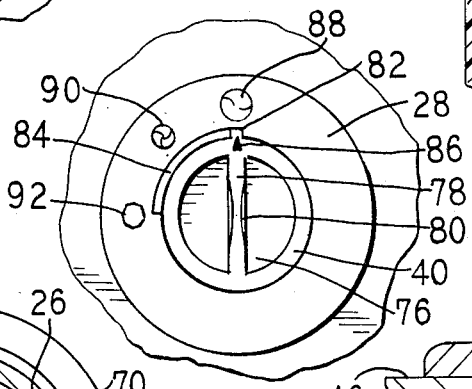
FIG. 4
FIG. 3
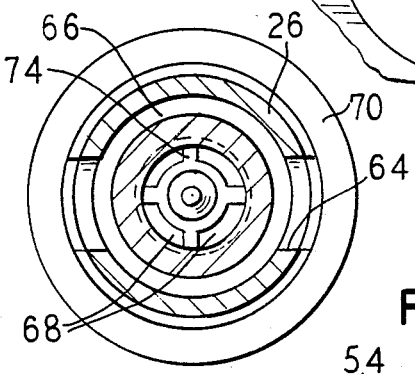
FIG. 6
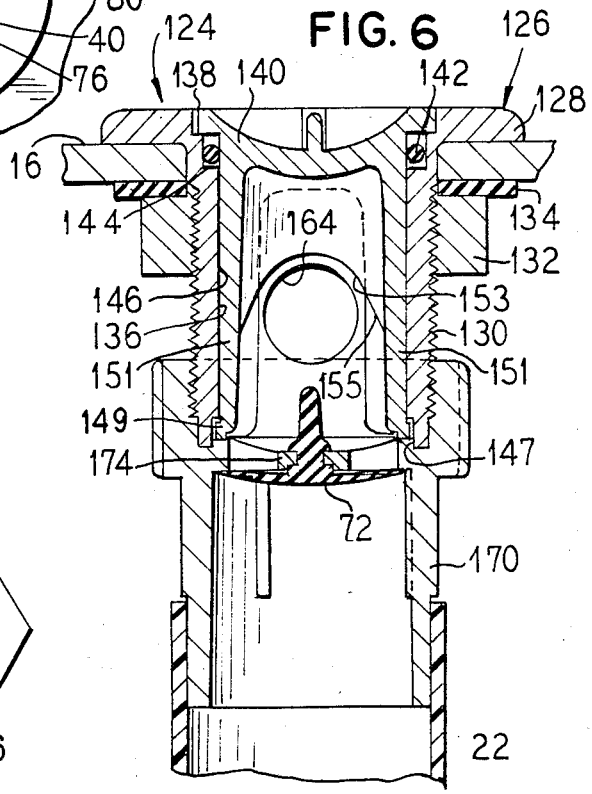
FIG. 5
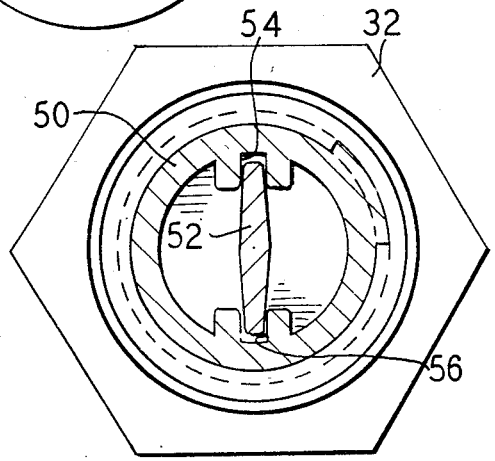

AIR CONTROL VALVE

BACKGROUND OF THE INVENTION

1. Field of the Invention

This invention relates to an air control valve and more specifically to a control valve for use in an air line connected to a hydrotherapy jet.

2. Description of the Prior Art

Air control valves used to supply air for hydrotherapy jets are commonly used in spas and whirlpools and are usually positioned on the top lip or rim of the spa shell and obtain intake air for the jet in close proximity to the spa user's ear. The air rushing in through the valve can create an undesirable level of noise in an otherwise relaxing atmosphere. Also, items may be tossed or placed on top of the valve, such as towels, balloons or toys, which tend to block off the air flow. Additionally, the air intake can also be filled with water from inside the spa due to overfilling or splashing, thereby rendering the jet less effective with no aspiration.

Many currently available air control valves provide air adjustment using a threaded valve barrel, thus not providing the user with any visible indication of the degree to which the valve is opened.

U.S. Pat. No. 3,874,374 discloses an air control valve in which a housing is secured below the rim of a hydromassage tub which includes a valve assembly regulated by control levels accessible on the rim. Air enters the housing past a check valve and then passes through ports in air caps which are selectively alignable with ports in air tubes to continue into air conduits to hydromassage jets. The air caps are rotatable by rotating the control knobs which project above the level of the rim.

SUMMARY OF THE INVENTION

The present invention provides an air control valve which obtains the intake air from beneath the top lip of the spa shell, but with a control knob accessible from the top lip or from the interior of the spa shell. This is done through a rotor inside a flange of a valve body with matching ports in the valve body underneath the lip. Alternatively, it may be done through a threaded rotating barrel axially movable independent from the control knob to vary the air flow passage through the valve. This provides a barrier of acrylic and fiberglass between the air intake and the user's ear which reduces the noise below that of other surrounding noises. A seal is provided at the top of the rotor and flange to prevent water from entering the valve from the spa. Also, a check valve is included in the valve assembly to prevent water from backing up through the valve assembly if the outlet openings of the hydrotherapy jets are plugged.

The control knob used with the valve embodying the principles of the present invention is rotatable through 90° between a fully closed position and a fully opened position and indicia markings are provided adjacent to the control knob to indicate to the user the degree to which the valve is opened.

The control knob is mounted in a flange of the valve body on the rim and has a recessed profile thereby providing a less obtrusive mechanism on the spa rim. No additional housing is required for the valve body which is held against the rim by a single jam nut thereby resulting in a compact and inexpensive control valve assembly which is easy to assemble.

BRIEF DESCRIPTION OF THE DRAWINGS

FIG. 1 is a side elevational view of the valve assembly attached to a hydrotherapy jet taken through a section of a hydrotherapy spa.

FIG. 2 is a side cross sectional view of the valve assembly.

FIG. 3 is a sectional view taken generally along the lines III—III of FIG. 2.

FIG. 4 is a plan view of the control knob portion of the valve assembly.

FIG. 5 is a sectional view taken generally along the lines V—V of FIG. 2.

FIG. 6 is a side section view of an alternative embodiment of a valve assembly embodying the principles of the present invention.

DESCRIPTION OF THE PREFERRED EMBODIMENTS

Although the control valve embodying the principles of the present invention can be used to control the flow of any fluid through the valve body where it is desirable to have the fluid intake remote and isolated from the control knob, by way of example and illustration, the invention is shown in an environment of a hydrotherapy spa and is used to control the flow of air to the hydrotherapy jets.

In FIG. 1 there is a partial showing of a hydrotherapy spa generally at 10 with a shell 12 forming an inner wall 14 to hold a quantity of water 15 and a top rim 16 extending around the circumference of the shell which is connected to an outer wall 17. Mounted through the inner wall 14 are a plurality of hydrotherapy jets 18 (only one shown) which project into a space 19 between the shell walls 14, 17 and are provided with a supply of water under pressure through conduits 20 forced through a nozzle causing an aspiration of air through an air inlet conduit 22 connected to atmosphere through a valve assembly 24.

The valve assembly 24 is shown in full lines as being mounted on the spa rim 16, however, since the valve draws air from the space 19 within the shell, the valve may also be mounted on the inner wall 14 above or below the water line 15. As described below, the valve assembly is mounted in a water tight manner to the spa wall and therefore its placement position on the spa shell is unlimited.

The valve assembly 24, which embodies the principles of the present invention, is shown in greater detail in FIGS. 2–6. In FIG. 2 the side cross sectional view of the valve assembly 24 is shown where it is seen that there is a valve body 26 which extends through an opening in the rim 16 and has an enlarged flange area 28 which overlies a portion of the top of the rim 16 and exhibits a low profile above the rim. The remainder of the body 26 extends downwardly into the open area 19 within the shell, between the inner 14 and outer 17 walls, and comprises a cylindrical threaded portion 30. The valve body 26 is secured against the rim wall 16 by means of a jam nut 32 which engages the threaded cylindrical portion 30 and is advanced against a seal member 34 such as a gasket to provide a water-tight connection for the valve body 26 to the rim 16 or elsewhere on the spa shell.

The valve body 26 has a central passage 36 therethrough for receiving various components of the valve assembly. At the flange end of the valve body, the passage 36 has an enlarged circumference 38 to receive a control knob 40 which is selectively rotatable within the passage. An O-ring seal member 42 is provided between the control knob 40 and the enlarged passage area 38 and is seated on a shoulder 44 forming the top end of a main portion 46 of the internal passage 36.

The main portion 46 of the passage 36 has an internal thread 48 therein for receiving an externally threaded movable valve member 50. As seen in FIGS. 2 and 5, the control knob 40 has a downwardly extending tongue 52 which is engaged in opposing slots 54, 56 in the movable valve member 50. In this manner, rotation of the control knob 40 will drivingly rotate the valve member 50. Rotation of the valve member 50 will result in an axial movement of the valve member relative to the valve body 26 and control knob 40.

The valve member 50 has at its lower end 58 an O-ring seal member 60 to engage in a valve seat portion 62 in the central passage 36 in the valve body 26. The valve body 26 has a pair of opposed openings 64 through the threaded cylindrical portion 30, as best seen in FIG. 3, to permit air to be drawn from the space 19 within the spa shell 12 into the valve assembly 24 to pass into the air conduit 22. As the air enters through openings 64, it passes through an annular space 66 between the main portion 46 of the valve body central passage 36 and the valve member 50, beneath the bottom end 58 of the movable valve member 50 and through openings 68 in the bottom of the valve body 26.

An adaptor member 70 is threadingly received on an end of the valve body 26 to which the air conduit 22 is connected. To prevent water from backing up into the valve body and discharging through openings 64 into the space within the spa shell 12 when the hydrotherapy jet 18 is blocked, a flexible check valve 72 is held in a spider 74 just below the openings 68 in the bottom of the valve body 26. As air is drawn into the conduit 22, the flexible umbrella portion of the check valve 72 moves away from the bottom wall of the valve body 26 to allow passage of air. If there is a back flow of air or water through openings 68, the umbrella portion will seal against the bottom wall of the valve body 26 preventing further upward movement of water or air through the valve assembly.

The control knob 40 has a recessed top surface 76 received in the valve body 26 such that an outer circumference 77 of the knob 40 is flush with the top surface of the flange portion 28 and the central portion of the top surface 76 is recessed below the top surface of the flange area 28 to provide an unobtrusive profile to the control valve assembly. An elevated diametrical wall 78 extends across the top surface 76 of the knob 40, which has a low profile above the top surface of the flange area 28 and has a serrated external surface 80 to provide a knurled gripping surface to assist a user in grasping and rotating the knob 40. The knob also has a projection 82 at one point on the outer circumference of the knob near the top surface which is received in an arcuate slot 84 in the flanged portion 28 of the valve body 26. The arcuate slot 84 extends through 90° and the end walls of the slot act as stops to prevent further rotation of the knob 40.

Indicia markings are provided on the flange 28 along the length of the slot 84 to indicate to the user the condition of the valve. A small pointer 86 is provided on the projection 82 which can be aligned adjacent to any of the indicia markings. A first marking 88 represents an open valve, a second marking 90 represents a partially closed valve and a third marking 92 is in the shape of an octagon representing a closed valve. When the pointer is rotated to be adjacent to the closed valve indicia marking 92, the movable valve member 50 will be moved downwardly constricting the air flow passage until the O-ring 60 is seated in the valve seat 62 thereby preventing passage of air through the valve assembly. In this position, the hydrotherapy jet 18 will eject only water under pressure and no air. As the control knob 40 is rotated, moving the pointer 86 toward the open valve symbol 88, the movable valve member 50 will be lifted away from the valve seat 62, dilating the air flow passage, thereby allowing greater amounts of air to pass through the valve body and out through the hydrotherapy jet 18.

In FIG. 6 there is shown an alternate embodiment of a valve assembly 124 which includes a valve body 126 having a flanged portion 128 overlying the spa rim 16. The valve body 126 extends through an opening in the spa rim 16 and has a cylindrical threaded portion 130. A jam nut 132 engages the threaded cylindrical portion 130 and is used to tighten the valve body 126 sandwiching a gasket 134 between the nut 132 and the spa rim 16 as described above.

A central passage 136 extends through the valve body 126 and has an enlarged area 138 to receive the circumference of a control knob 140. An O-ring seal member 142 is provided between the valve body 126 and the control knob 140 which rests on a step 144 forming the top end of a main portion 146 of the passage 136. The passage 136 has an enlarged bottom end 147 for receiving an enlarged circumferential retaining portion 149 of the control knob 140.

The valve body 126 has a pair of opposed openings 164 through the threaded cylindrical portion 130. The control knob 140 has a pair of opposed legs or lands 151 which extend below the level of the openings 164. The legs 151 are connected by a cylindrical wall 153 which has a pair of opposed arcuate relieved portions 155 which at their highest point are above the level of the openings 164 such that as the control knob 140 is rotated about its axis, the relieved areas 155 are moved in and out of registration with the openings 164 to present an effective opening having a maximum dilated size of the opening 164 which can be reduced or constricted to no opening. Thus, a 90° rotation of the control knob 140 provides the range of full open to closed.

An adaptor member 170 is threaded onto the cylindrical threaded portion 170 of valve body 126 and is sized to receive the air conduit 22. The flexible umbrella type check valve member 72 is received in a spider 174 formed in the adaptor 170.

The operation of this alternative valve assembly is virtually identical to that described above in that air is drawn into the valve assembly from the underside of the spa rim thereby isolating the noise associated with the valve, and the control knob may be rotated through 90° providing a range of a full on to a full off position for the air intake.

Thus, it is seen that the present invention provides for an air control valve used to supply air for hydrotherapy jets which considerably reduces the noise associated with the valve and also reduces the poseibility of blocking the air flow to the valve by placement of articles on the spa rim. The user is provided with a visible indication of the degree of constriction of the valve, and backflow of water from a blocked hydrotherapy jet is prevented.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution of the art.

We claim as our invention:

1. A fluid control valve assembly comprising:

a valve body adapted to be mounted through a wall, said valve body having a cylindrical bore therethrough and at least one opening through a side wall thereof to communicate with said bore thereby forming a fluid passage, a movable valve member carried in said bore and actuated by a control knob engaged in said valve body, said valve member movable in said fluid passage to selectively constrict or dilate said passage, said control knob accessible on a side of said mounting wall opposite the location of said valve body opening, said control knob and said valve member being rotatably movable relative to said valve body, and said valve member being axially movable relative to said control knob and said valve body, said control knob having an axially extending tongue portion received in slots in said movable valve member to permit said valve member to move axially relative to said control knob while still being rotatably actuated by said knob, a check valve member positioned between said movable valve member and said air conduit to prevent back flow of water through said valve assembly, whereby fluid enters said valve body remote and isolated by said mounting wall from said control knob.

2. The device of claim 1 wherein said valve body mounts through said wall by having an upper flange resting on a top surface of said wall and fastening means engaged below said wall, said control knob being recessed in said flange to present a low profile of said control valve assembly above said wall.

3. For use in a hydrotherapy spa having an inner and outer wall with a connecting rim and a hydrotherapy jet mounted in said inner wall which aspirates air through an air conduit, an air control valve assembly comprising:

a hollow valve body having a flange portion seated above said rim and a cylindrical portion extending below said rim and between said walls, said valve body having at least one opening through said cylindrical portion forming an air passage through said valve body, a movable valve member carried in said valve body and actuated by a control knob to selectively change said air passage size between a minimum and maximum size, said control knob and said valve member being rotatably movable relative to said valve body, and said valve member being axially movable relative to said control knob and said valve body, said control knob having an axially extending tongue portion received in slots in said movable valve member to permit said valve member to move axially relative to said control knob while still being rotatably actuated by said knob, a connection means between said valve body and said air conduit, and a check valve member positioned between said movable valve member and said air conduit to prevent backflow of water through said valve assembly.

4. The device of claim 3 wherein said control knob is accessible at said rim.

5. The device of claim 4 wherein said control knob is rotatable through an angle of 90° to actuate said movable valve member.

6. The device of claim 5 including indicia markings adjacent to said control knob to provide a visual indication of the position of said movable valve member.

7. The device of claim 3 wherein said check valve member comprises an umbrella-type flexible valve member mounted in a spider at a bottom end of said valve body.

8. The device of claim 3 wherein said check valve member comprises an umbrella-type flexible valve member mounted in a spider in said connection means between said valve body and said conduit.

9. The device of claim 3 wherein said movable valve member is threadingly received in said valve body such that rotation of said movable member causes axial movement of said movable member.

10. The device of claim 3 wherein downward axial movement of said movable member causes a lower end of said movable member to seat in a valve seat in said valve body to completely seal said air passage through said body.

11. For use in a hydrotherapy spa having an inner and outer wall with a connecting rim and a hydrotherapy jet mounted in said inner wall which aspirates air through an air conduit, an air control valve assembly comprising:

a hollow valve body having a flange portion seated above said rim and a cylindrical portion extending below said rim and between said walls and being connected to said air conduit, said valve body being secured to said rim and having at least one opening through said cylindrical portion forming an air passage through said valve body to said air conduit, a movable valve member carried in said valve body and actuated by a control knob to selectively constrict or dilate said air passage, said control knob rotatably mounted in said flange portion of said valve body and being accessible above said rim, said control knob being distinct from said movable valve member such that rotary movement of said control knob is translated into axial movement of said movable member through a threaded connection between said movable member and said valve body, and a check valve member positioned between said valve body opening and said air conduit to prevent reverse flow through said air passage, whereby, rotation of said control knob regulates the flow of air through said air conduit.

* * * * *